US006033142A

United States Patent [19]

Gueret

[11] Patent Number: 6,033,142

[45] Date of Patent: Mar. 7, 2000

[54] APPLICATOR UNIT FOR A LIQUID OR SEMI-LIQUID PRODUCT

[75] Inventor: Jean-Louis Gueret, Paris, France

[73] Assignee: L'Oreal, Paris, France

[21] Appl. No.: 08/926,689

[22] Filed: Sep. 10, 1997

[30] Foreign Application Priority Data

Sep. 10, 1996 [FR] France ..... 96 11032
Oct. 7, 1996 [FR] France ..... 96 12199

[51] Int. Cl.[7] ..... A45D 34/04

[52] U.S. Cl. ..... 401/122; 401/129; 35/218

[58] Field of Search ..... 401/122, 129; 132/218

[56] References Cited

FOREIGN PATENT DOCUMENTS 63-18978 5/1988 Japan .

*Primary Examiner*—Charles R. Eloshway

*Attorney, Agent, or Firm*—Oblon, Spivak, McClelland, Maier & Neustadt, P.C.

[57] ABSTRACT

An applicator unit for a liquid or semi-liquid product that wipes excess product from the stem and applicator. The excess product is wiped by a sleeve through which the applicator charged with the product is caused to pass. The sleeve is open at its two ends, and having an internal surface capable of retaining a reserve of the product by the surface tension effect. The force of the surface tension exerted between the sleeve and the product contained therein is greater than the force of the surface tension exerted between the free end of the applicator and the product. Thus, excess product remains in the sleeve and not on the applicator.

26 Claims, 7 Drawing Sheets

APPLICATOR UNIT FOR A LIQUID OR SEMI-LIQUID PRODUCT

BACKGROUND OF THE INVENTION

1. Field of the Invention

The invention relates to an applicator unit for a liquid or semi-liquid product, such as a cosmetic product. The invention concerns more particularly, but not exclusively, an applicator unit of the eyeliner type. Other applications in the cosmetic field may be envisaged such as, in particular, the application of hair products, a liquid serum, nail varnish, eyeshadow, liquid lip rouge, mascara, etc. The invention also applies to fields other than cosmetics. Glues may be mentioned by way of example.

2. Discussion of the Background

An applicator unit of the above mentioned kind conventionally comprises a bottle provided with a threaded neck and intended to contain a liquid or semi-liquid product, a cap closing the bottle by being screwed onto the neck and an applicator disposed at the end of a stem joined to the cap. This applicator generally also includes means for wiping the applicator and wiping the stem.

FR-A-2 470 066 relates to a device of the above mentioned type, into the neck whereof there is placed a molded part having lips forming scrapers disposed on top of one another and having a triangular cross-section. Such a scraper makes it possible not only to wipe the stem, but also to wipe the applicator, which in this case is a brush.

EP-A-0 640 302 describes a mascara applicator comprising a wiper element of an annular shape and provided with a plurality of projections extending radially inward of the reservoir, intended to scrape off the excess of the product on the applicator when it is being withdrawn from the reservoir.

French Patent Application 95/02197, filed in the name L'Oreal on Feb. 24, 1995, describes an applicator unit for a liquid or pasty product comprising a diabolo-shaped wiper made of a deformable elastic material traversed by the applicator during its extraction from the reservoir. The wiper is capable of wiping the stem and of increasing its passage cross-section to allow the passing of an applicator element which has a cross-section greater than that of the stem.

FR-A-2 504 788 describes a make-up unit comprising a brush penetrating inside the reservoir through a flexible rubber body shaped as a glove finger whose pierced bottom forms a wiper lip which is denticulated so that its teeth are capable of penetrating into the grooves of the brush between two adjacent rows of bristles, so as to exert a wiping action inside the grooves.

Other wiper devices are, moreover, described in the FR-A-2 515 941, FR-A-2 579 430 or FR-A-2 580 479.

The wiping systems described in these documents are mechanical wiping elements wherein the wiping of the stem and/or of the applicator is effected by contact or friction between the wiper and the element to be wiped. However, these systems produce results which are sometimes inadequate, in particular when the applicator has a diameter substantially smaller than the diameter of the stem carrying it. This is, in particular, the case with certain applicators carried by a stem whose diameter may vary between 2.5 mm and 3 mm, the applicator taking the form of a tapered element whose largest diameter is of the order of 2 mm and whose tip has a diameter of the order of 0.2 mm. Thus, when such an applicator passes into a wiper element of the type described above, proper wiping of the stem is obtained. On the other hand, the free end of the applicator is not wiped and retains a larger or smaller drop of the product, such a drop subsequently renders difficult the application of the product which results in poor product quality.

Moreover, in the known devices, where the wiping is obtained by an elastically deformable annular element having a slit hole, the quality deteriorates in the course of use, because the material loses its elasticity. Moreover, when it is introduced into the slit hole the applicator is subjected to stresses which may irreversibly damage it.

Finally, in the glove finger-type device described in the above mentioned FR-A-2 504 788, the product entering the glove finger is too abundant to ensure a proper charging of the applicator, to the detriment of the fineness of the point.

Thus, all known devices are of two types. In a first type, the wiper is dimensioned to the diameter of the applicator, so as to wipe the applicator by friction (of the type of a wiper with a slit hole). In this case, because of the small diameter of the slit hole in its rest position, the applicator is subjected to high mechanical stresses, in particular when it is introduced, which may irreversibly damage it. Moreover, the wiper with a slit hole loses its elasticity in the course of use, which inevitably entails a deterioration in the quality of the wiping. With a second type, the diameter is dimensioned to the diameter of the stem, in which case the applicator passes through the wiper without being correctly wiped.

SUMMARY OF THE INVENTION

Thus one of the objects of the present invention is to make a wiping device allowing the applicator to be wiped over its whole length, while eliminating the drop effect at the free end of the applicator, described with reference to the devices of the prior art, without subjecting the applicator to mechanical stresses liable to damage it irreversibly, in particular during its insertion.

Another object of the invention is to provide a wiper device comprising conventional wiping means for producing proper wiping of the stem carrying the applicator.

Further objects of the present invention will emerge in greater detail in the description that follows.

The Applicants have, surprisingly, discovered that in the applicator units for liquid or semi-liquid products, the conventional wipers with a wiping action by contact or friction can be advantageously replaced or supplemented by a new wiping system whose operation is based on the mechanism of the forces of surface tension.

The above objects of the invention are attained by means of an applicator unit for a liquid or semi-liquid product comprising: a reservoir intended to contain the product, the reservoir having a bottle, a body and an opening; closing means or stopper for obturating the opening; an applicator carried by a stem joined to the closing means and mounted so as to be brought into contact with the product inside the reservoir in the closed position of the closing means, the applicator having a diameter smaller than or equal to the diameter of the stem, and having one end joined to the stem and a free end; and wiping means situated in the vicinity of the opening and through which the applicator is intended to pass, wherein the wiping of the applicator is in essence effected by the surface tension effect as the applicator passes through the said wiping means, the said applicator passing through the wiping means without any substantial friction with the said wiping means.

This wiping mechanism by the surface tension effect is particularly advantageous as compared with the conventional wiping mechanism operating primarily by mechanical friction between the applicator and the wiper, inasmuch as the applicator is not damaged during its passing through the wiper, and this both during its insertion and extraction.

Advantageously, the wiping means comprise a sleeve through which the applicator, charged with the product, is caused to pass, the sleeve having a minimum internal diameter greater than the maximum diameter of the applicator (generally in the vicinity of its end joined to the stem), the sleeve being open at its two ends and having an internal surface capable of retaining a reserve of the product by the surface tension effect, and the surface tension force exerted between the internal surface of the sleeve and the product retained therein being greater than the surface tension force exerted between the free end of the applicator and the product. Thus, even at the place of the sleeve with the smallest cross-section, the applicator does not rub noticeably between the sides of the sleeve.

Thus, practically the whole excess of the liquid at the end of the applicator (in the form of a drop carried at the end of the applicator) is drawn from the applicator and retained in the sleeve. The quantity of liquid not retained in the sleeve is spread practically uniformly over the whole height of the applicator because of the restoring force generated by the elasticity of the drawn-out liquid product. The applicator is thus perfectly smoothed and its free end is substantially cleared of any excess product.

Within the meaning of the present application the rheology refers to the whole set of properties of a liquid or semi-liquid product in flow, and its behavior in response to a given stress and, encompasses apart from the surface tension, in particular the viscosity of the product.

Within the meaning of the present application, the forces of surface tension refer to the forces exerted at the interfaces between two phases, in particular between two liquids, identical or different, or between a solid surface and a liquid. The greater the surface tension force, the greater is the work to be done to separate the two phases. In the case of a liquid/solid interface, one generally refers to the work of wetting (per unit surface) to be provided to separate the two phases. The work necessary for separating a column of liquid into two is generally referred to as cohesional work. This surface tension force may be likened to negative pressure or low pressure. Within the scope of the invention, and for the purpose of simplification, we will consider primarily two interfaces: a first liquid/solid interface between the internal surface of the sleeve and the liquid in the sleeve; and a second liquid/solid interface between the end of the applicator and the liquid on the applicator.

According to the invention, the wiping effect is caused by the surface tension force at the first interface which is greater than, and preferably distinctly greater than, the surface tension force at the second interface. The difference in the surface tension force is due in particular to the fact that the surface of the sleeve whereon the force of the surface tension is exerted, is greater than, and preferably distinctly greater than, the surface of the end of the applicator whereon the force is exerted. Thus when the applicator emerges from the sleeve charged with the liquid after having passed therethrough, the liquid is drawn out and forms a liquid bridge between the sleeve and the applicator.

The force exerted on the side of the sleeve is greater than the force exerted on the side of the applicator, so that when the liquid bridge breaks, a large portion of the excess liquid at the end of the applicator is retained in the wiper element, the rest rising along the applicator in the form of a substantially uniform film. The drop effect mentioned with reference to the devices of the prior art has disappeared.

The wiping means may, moreover, comprise means permitting the stem to be wiped by friction, formed, for example, by a constricted zone arranged in the sleeve and capable of wiping the stem as it passes through the constriction.

In an alternative, the means for wiping the stem by friction include an annular element mounted above the sleeve and capable of wiping the stem during its passage through the annular element. The annular element may be made of a thermoplastic material or a thermoplastic elastomer.

Advantageously, the diameter of the applicator varies between a maximum value at its end joined to the stem, and a minimum value at its free end; the internal diameter $d_1$ of the sleeve, at least in its portion situated beneath the means for wiping the stem, is equal to 2 to 25 times, and preferably 5 to 25 times, the minimum value.

Typically, for a product whose viscosity is from $1\times10^{-3}$ Pa.s ($1\times10^{-3}$ Pa.s=$1\times10^{-3}$ Pascal×second=1 centipoise=1 cp) to 1 Pa.s (10p=10 poise), the internal diameter of the sleeve is from 2 mm to 10 mm, the height of the sleeve up to the wiping means of the stem is from 10 mm to 50 mm. Preferably, for a product whose viscosity is from $1\times10^{-3}$ Pa.s (1 cp) to $5\times10^{-1}$ Pa.s (5 p), the internal diameter of the sleeve is such that the annular space existing between the internal surface of the sleeve and the stem has a radial width $\delta$ which may range from a few $\mu$m to 1 mm, the height h of the sleeve up to the means for wiping the stem being from 10 mm to 20 mm.

In an advantageous mode of embodiment, the internal surface of the sleeve has a frustoconical cross-section whose diameter decreases in the opposite direction to the bottom of the reservoir.

The surface tension force exerted by the wiper on the liquid during the passing of the applicator may be reinforced by arranging fins disposed parallel to the axis of the sleeve on the internal surface of the sleeve. Other means such as slots, openings, grooves or other reliefs make it advantageously possible to increase the surface for attaching the liquid to the internal sides of the sleeve.

Advantageously, the sleeve has one or several slots or openings allowing the sleeve to be supplied with the product. These slots may be orientated perpendicularly to the axis of the sleeve, or parallel to the axis of the sleeve. In the latter case, the slots may open out on the edge of the sleeve situated opposite the bottom of the reservoir.

The invention also provides an applicator unit wherein the applicator is contained practically within the sleeve when the closing means are in their closed position on the reservoir. In an alternative, the applicator is held in position in the vicinity of the bottom of the reservoir when the closing means are in their closed position on the reservoir.

According to yet another alternative, the wiping sleeve is formed by the neck of the reservoir, it being advantageously possible for the neck to form an annular bead forming a constricted zone for the wiping of the stem, the reservoir being for example made by injection molding or by blow molding. Similarly, the means for wiping the stem may be constituted by a separate annular element mounted in a leakproof manner on the neck. Advantageously, the sleeve is delimited by two constrictions, an upper constriction formed by an annular element mounted in a leakproof manner on the neck of the reservoir, and a lower constriction formed in the neck of the reservoir, the product being held in position between the two constrictions by the surface tension effect.

The product contained in the applicator unit may include, but is not limited to, a hair product, a liquid serum, a mascara, an eyeliner, eyeshadow, a liquid lip rouge, and a glue.

BRIEF DESCRIPTION OF THE DRAWINGS

In the description that follows, reference will be made to the accompanying drawings wherein.

DESCRIPTION OF THE PREFERRED EMBODIMENTS

Figure 1:
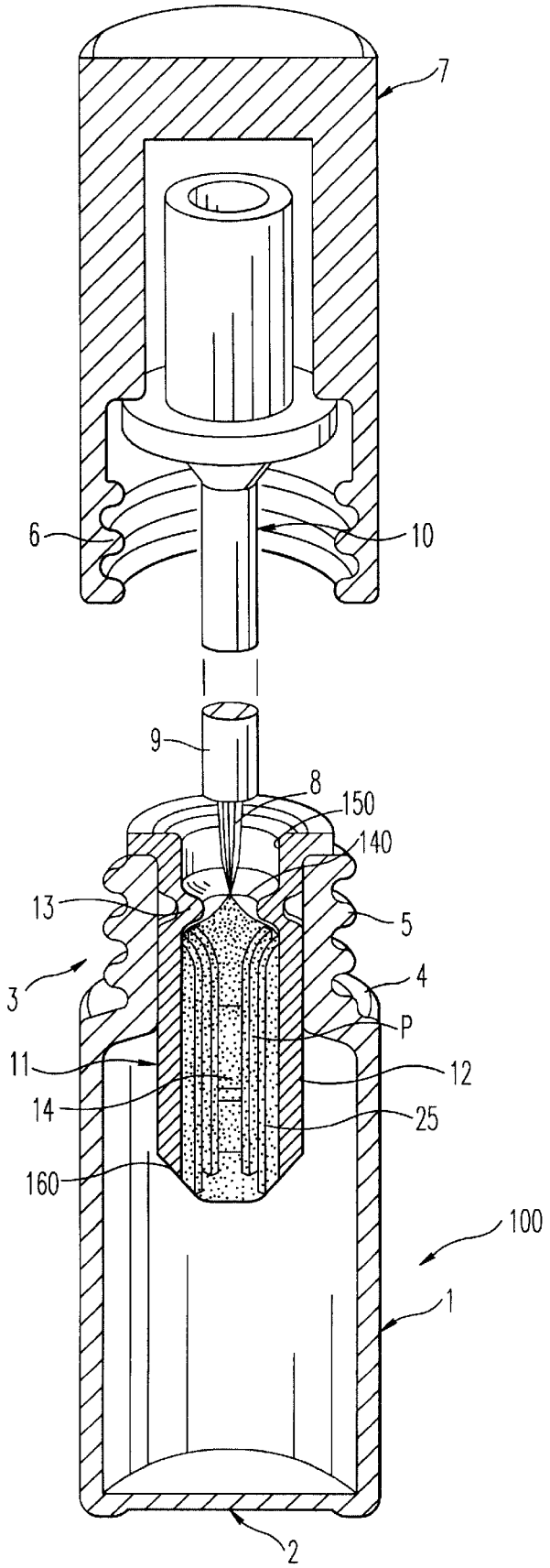
FIG. 1 is a pictorial cross-section of the operating principle of the wiper device according to the present invention.

As schematically shown in an axial section in FIG. 1, the applicator unit in accordance with the invention, (represented by the reference numeral 100 as a whole), comprises primarily a reservoir 1 having a bottom 2 whose body ends in a neck 3 joined to the body by a shoulder 4. The external surface of the neck has a thread 5 intended to cooperate with a corresponding thread 6 arranged on the internal surface of a stopper 7 with an external diameter substantially equal to the external diameter of the body of the reservoir. The stopper 7 carries an applicator 8 mounted on a stem 9. The diameter of the applicator 8 is at most equal to the diameter of the stem 9 and is preferably smaller than the diameter of the stem 9. The applicator 8 may be a substantially straight element with a diameter smaller than or equal to the diameter of the stem 9, or preferably a tapered element whose largest diameter (the end adjacent to the stem) is smaller than or equal to the diameter of the stem 9. In the case of a tapered element, the diameter of the free end of the applicator 8 is distinctly smaller than the internal diameter of the wiper sleeve 11. A sealing cone 10 is provided at the base of the stem 9 so as to obturate the opening of the reservoir 1 in a leakproof manner when the stopper 7 is screwed onto the body 1. By way of a non-restrictive example, the applicator 8 may take the form of a flocked quill, felt, a pencil brush, a brush and etc.

Figure 4:
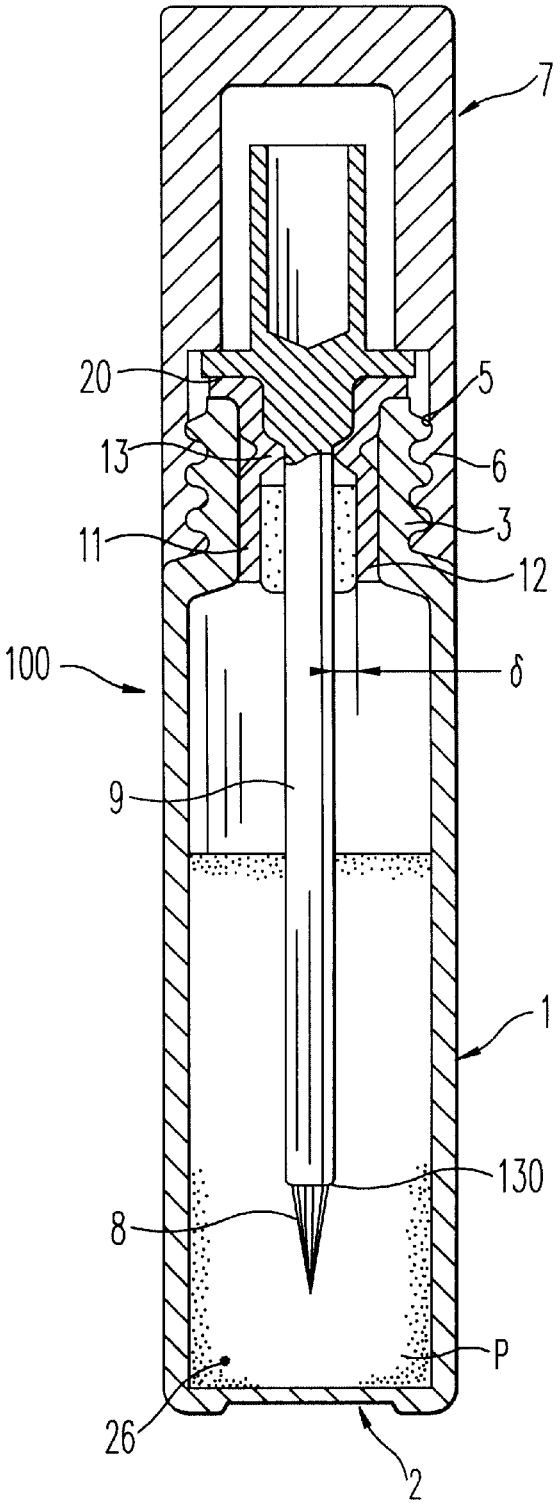
FIG. 4 is a sectional view of a first embodiment of an applicator unit in accordance with the present invention.
Figure 5:
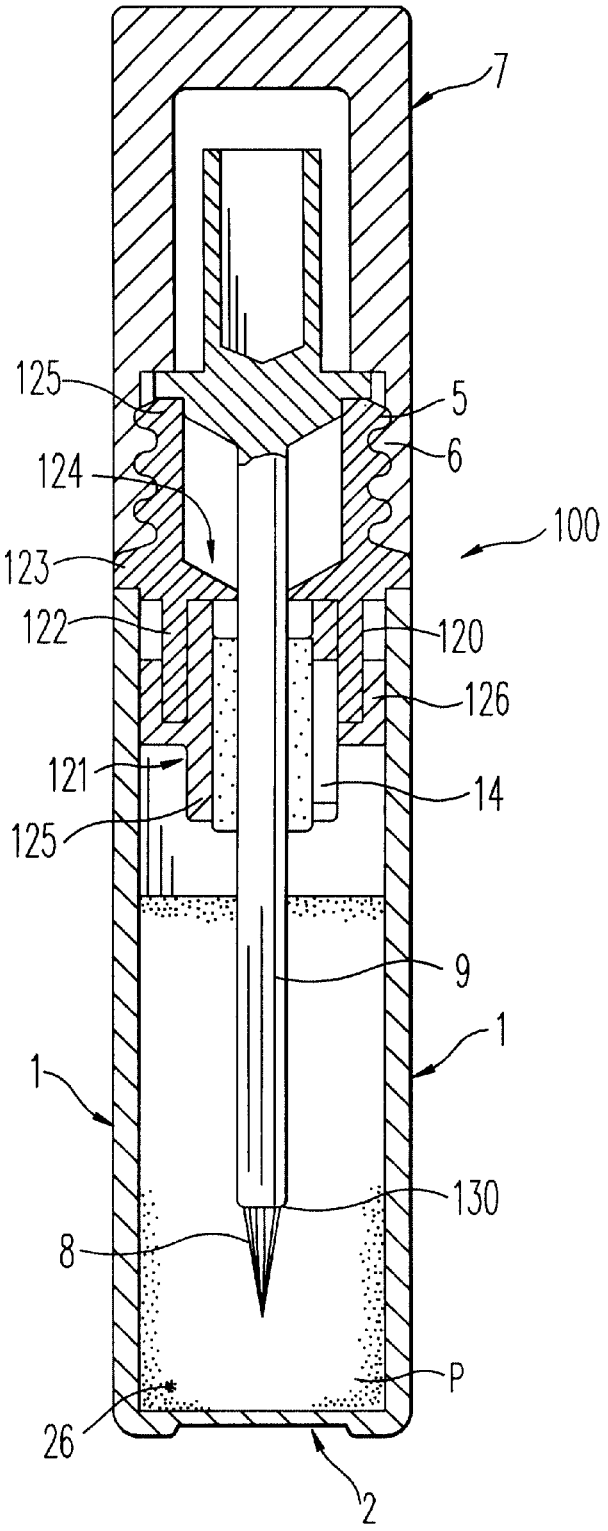
FIG. 5 is a sectional view of a second embodiment of an applicator unit in accordance with the present invention.

A wiper 11 of an annular shape which bears on the free edge of the neck 3 is mounted inside the neck 3, through which the applicator 8 passes to be brought into contact with the product to be applied so as to be charged with the product. The wiper 11 may be mounted on the neck in various ways. In a first embodiment, at least one annular rib is provided on the external surface of the wiper and intended to be brought into engagement with a corresponding annular groove provided on the internal surface of the neck 3. Alternatively, the wiper 11 may be force-fitted in the neck 3. Yet, other means may be provided for the mounting of the wiper 11 on the neck 3. Similarly, the applicator unit may be arranged so that, in the closed position of the stopper 7, the applicator 8 stays practically in the wiper 11 (FIG. 6), or passes through the wiper 11 to stay practically at the bottom of the reservoir 1 (FIGS. 4 and 5).

In the embodiment shown in FIG. 1, the wiper 11 takes the form of a sleeve 12 open at its two ends. Over the greater part of its height, the sleeve 12 has an internal diameter greater than the diameter of the stem 9. In the vicinity of its upper portion, the sleeve 12 forms a constriction 13 whose internal diameter can be substantially equal to the diameter of the stem 9 (or even slightly smaller in the case of an elastically deformable material), so as to wipe the stem 9 as it passes through. This constriction 13 will be discussed in greater detail below.

The sleeve 12 has an internal surface capable of retaining a reserve of the product P by a surface tension effect, it being possible for the feeding to be effected, in particular, through slots or other appropriate openings as will be seen in greater detail below. The quantity of the product P retained inside the sleeve 12 depends on its geometry, on its internal surface characteristics, and on the rheology of the product P (in particular its viscosity).

According to the invention, by withdrawing the applicator 8 charged with the product P from the reservoir 1 after the stopper 7 has been unscrewed, the applicator 8 is caused to pass through the sleeve 12 and through the product reserve retained therein by the surface tension effect or capillarity. At the moment when the applicator 8 emerges from the sleeve 12, a liquid bridge 140 is formed between the sleeve 12 and the applicator 8. As the applicator 8 continues to rise relative to the sleeve 12, the liquid bridge 140 is broken by the breaking of the surface tension. Since the force of the surface tension at the interface between the internal surface of the sleeve 12 and the liquid is greater than the force of the surface tension exerted at the interface between the liquid product and the end of the applicator 8, virtually the whole of the excess product on the applicator 8 is retained in the wiper sleeve 12.

Apart from the surface characteristics of the sleeve 12, this difference in the surface tension force is due to the fact that the volume retained inside the sleeve 12 by the surface tension effect is greater, and preferably distinctly greater, than the volume of the drop carried by the applicator 8. This difference in volume is due to the difference of the surface whereon the surface tension force is exerted in the sleeve 12, as compared with the surface of the end of the applicator 8 whereon the surface tension force is exerted. Typically, the internal surface of the sleeve 12 whereon the liquid is retained by the surface tension effect is equal to at least 5 times, and preferably at least 10 times, the surface of the applicator 8. The internal diameter of the sleeve 12 (beneath the constriction 13) that is to say, substantially at the level of the surface of the liquid in the sleeve, is equal to 2 to 25 times, and preferably 5 to 25 times, the diameter of the end of the applicator 8. In the case of a sleeve 12 having fins or other reliefs on the internal surface of the sleeve, this will be the diameter taken at the base of the fins or of the reliefs, that is to say, the largest internal diameter. In fact, the greater the difference in diameter, the more rapidly the liquid bridge will be broken above the surface of the product P in the sleeve 12 and the more the drop effect will be resolved in a satisfactory manner. Such a wiper 11 device makes it possible, with substantially no friction between the applicator 8 and the internal walls of the sleeve 12, to retain virtually the whole of the excess product P at the end of the applicator 8 inside the sleeve 12. For the purpose of the illustration, the diameter of the sleeve 12 has been voluntarily shown as distinctly greater than the diameter of the stem 9. In practice, a few microns in the difference in diameter may be sufficient.

In the embodiment in FIG. 1, the internal surface of the sleeve 12 has fins 25 capable of increasing the surface tension of the product P by the surface tension effect inside the sleeve 12, as will be seen in greater detail below. Typically, these fins 25 may have a radial depth of between 1 mm and 2 mm. The internal diameter of the sleeve 12 formed at the tip of the fins 25 is preferably slightly greater than the diameter of the stem 9. Moreover, the sleeve terminates at its lower portion in a beveled portion 160.

Advantageously, in its upper portion the sleeve 12 forms a constriction 13 whose diameter is chosen so as to wipe the stem 9 by friction during the emergence of the applicator 8 from the reservoir 1 with a view to applying the product P, it being possible for appropriate means, such as a slot, to be provided at the level of the constriction 13 to avoid the piston effect produced by the rising of the stem 9. The constriction 13 is dimensioned in such a way as to have substantially no wiping effect on the applicator 8. Typically, the internal diameter of the constriction 13 is substantially equal to, or very slightly greater than, the external diameter of the stem 9. Yet the constriction 13 promotes the wiping by the surface tension effect of the applicator 8, inasmuch as a kind of stop is formed beneath which (or in the vicinity of which) the break of the liquid bridge 140 is produced. The portion 150 of the sleeve 12 situated above the constriction 13 may have an internal diameter greater than the internal diameter of the rest of the sleeve 12, so as to facilitate the insertion of the applicator into the sleeve and to prevent the liquid from being retained in the portion by the surface tension effect. Typically, the internal diameter of the portion 150 may be of the order of 7 mm to 8 mm for an internal diameter of the lower portion of the sleeve 12 comprised between 2.5 mm and 4.5 mm. The height of the portion 150 is of the order of 10 mm. As is clearly apparent in FIG. 1, with such a configuration, the liquid is contained as a whole in the portion of the sleeve 12 situated beneath the constriction 13.

By using an elastically deformable material, it will be possible to provide a constriction 13 with a diameter slightly smaller than the diameter of the stem 9, and preferably distinctly greater than the diameter of the free end of the applicator 8, so that the applicator can be introduced practically without stress into the reservoir 1. As a result, the constriction 13 dimensioned to the diameter of the stem 9 produces practically no action of friction or wiping by the applicator 8, whose diameter is smaller, even distinctly smaller, in particular in the vicinity of the free end. This is so both on insertion of the applicator 8 and during its extraction. In these conditions the applicator 8 can be introduced into the reservoir 1 or be extracted from the reservoir 1 without its free end being damaged by the wiper 11 of the stem 9.

The constriction 13 constitutes an additional means for retaining the liquid and increases the wiper's 11 capacity to retain the product P inside the sleeve 12 by the surface tension effect, which accelerates the breaking of the liquid bridge 140 and promotes the wiping effect. Yet these friction wiping means are not indispensable. Indeed, in particular in the case of low viscosity products, the wiping of the stem 9 may also be effected by "licking", by the surface tension effect when the stem 9 passes through the wiper sleeve 11. For this purpose, the stem 9 will be made of a sufficiently smooth material, so that the liquid clings only weakly to the surface of the stem 9, as compared with surface tension forces which it meets when passing through the wiper sleeve 11.

The sleeve 12 preferably has at least one slot 14 or an opening permitting the sleeve 12 to be fed so as to create a reserve of the product P in it and, on the other hand, to promote the complete emptying of the reservoir 1. Charging the wiper 11 with the product P may also be effected via the lower opening. As will be seen in greater detail below, these slots 14 or openings also make it possible to increase the capacity of the sleeve 12 to retain some of the product P by capillarity or the surface tension effect.

Thus, with a view to applying the product P, the user will preferably shake the container, possibly by upending it, which causes liquid to enter (either through the bottom or through the lateral fins) into the sleeve 12 within which it will be held by the surface tension effect. When the user unscrews the stopper 7 from the reservoir 1, it causes the stem 9 and the applicator 8 to rise within the body of the reservoir 1, the applicator 8 being charged with the product P. The stem 9 passes through the constricted zone 13 at the level of which it is wiped. The wiped liquid is kept, at least partly, in the sleeve 12 beneath the constriction 13 by the surface tension effect. The applicator 8 then passes through the sleeve 12 where the product P is situated. When the applicator 8 has left the lower portion of the sleeve 12 containing the product P, a liquid bridge 140 is created between the applicator 8 and the sleeve 12. Because of the geometry and the condition of the surface of the sleeve 12, the surface tension force exerted by the liquid in the sleeve 12 is greater than the surface tension exerted between the applicator 8 and the liquid, so that when the liquid bridge 140 is broken, the excess product P carried by the applicator 8 (in the form of an end drop) is partly drawn away from the applicator 8 and remains in the sleeve 12. The rest of the product P rises by elasticity along the applicator 8 while forming a fine film with a substantially uniform thickness.

The effect of this breaking of the surface tension makes it possible to obtain an applicator 8 saturated with the product P, but whose end does not have a drop, which permits a very precise application of the product and a very fine line. When the user reinserts the applicator 8 into the reservoir 1, a portion of the product P contained in the sleeve 12 is pushed back into the reservoir 1, the rest being held in the sleeve 12 by the surface tension effect.

The wiping effect by the surface tension effect is obtained by an appropriate choice of the geometry of the sleeve 12 as well as the condition of the surface of the sleeve 12. Typically, for a product whose viscosity is from $1\times10^{-3}$ Pa.s (1 cp) to 1 Pa.s (10 p), the internal diameter of the sleeve 12 ($d_1$, FIG. 2A) is from 2 mm to 10 mm, and the height (h, FIG. 2A) of the sleeve 12 up to the wiping means of the stem is from 10 mm to 50 mm. Still more preferably, for a product whose viscosity is from the $1\times10^{-3}$ Pa.s (1 cp) to $5\times10^{-1}$ Pa.s (5 p), the internal diameter $d_1$ of the sleeve 12 is such that the annular space comprised between the internal surface of the sleeve 12 and the stem 9 has a radial width $\delta$ of the order of a few $\mu$m to 1 mm, the height h of the sleeve 12 up to the wiping means of the stem being from 10 mm to 20 mm.

More specifically, for a product with an average viscosity of approximately $50\times10^{-3}$ Pa.s (50 cp) to $3\times10^{-1}$ Pa.s (3 p) (for example, an eyeliner with a viscosity of the order of $50\times10^{-3}$ Pa.s to $70\times10^{-3}$ Pa.s), one will use a stem 9 of a diameter of 2.5 mm. The applicator 8 has a diameter which is of the order of 2 mm at its end joined to the stem and 0.2 mm at its free end. The internal diameter $d_1$ of the sleeve 12 may range from 2.6 mm to 4.5 mm. The height h of the sleeve 12 up to the constriction 13 is of the order of 15 to 20 mm. The constriction 13 has an internal diameter substantially equal to the diameter of the stem 9. Thus the minimum diameter of the wiper 11 (that is to say, at the level of the constriction, if applicable) is greater than the maximum diameter of the applicator 8 (at its end joined to the stem), and in the case of an applicator 8 of a tapered shape, the minimum diameter of the wiper 11 (at the level of the constriction, if applicable) is distinctly greater (here approximately 12.5 times) than the diameter of the free end of the applicator 8. In these conditions, the wiping of the applicator 8 is effected by the surface tension effect without any substantial friction between the applicator 8 and the side of the sleeve 12. The applicator 8 can be introduced into the reservoir 1 without any risk of damage. The quality of the wiping remains constant in the course of use.

The capacity of the wiper 11 to hold the liquid by the surface tension effect will be increased by an appropriate choice of the materials forming the sleeve 12. By way of example, one will use a thermoplastic material, an elastomer, a thermoplastic elastomer, or a heat setting material (Bakelite, urea formaldehyde). Advantageously, different materials will be used for different parts of the wiper 11. Still advantageously, the surface of the sleeve 12 may be subjected to a process such as electrochemical processing, or by the corona effect, so as to increase the internal surface of the sleeve 12.

Similarly, various reliefs may be provided on the internal surface of the sleeve 12, capable of increasing still further the attachment surface for the liquid in the sleeve 12, and thus improving the wiping capacity of the sleeve 12. Preferably, slots will be provided which, moreover, allow the sleeve 12 to be fed with the product. Other reliefs may also be provided on the internal surface of the sleeve, such as ribs, fins, groove, striations or other equivalent means. The internal diameter of the sleeve 12 generated by the tip of the reliefs is preferably slightly greater than the diameter of the stem 9. As for the internal diameter at the bottom of the relief, it is distinctly greater than the diameter of the free end of the applicator 8.

The shape of the cross-section of the stem 9 may, of course, be other than a cylinder of revolution. By way of example, oval, hexagonal or other shapes are used.

Figure 2A:
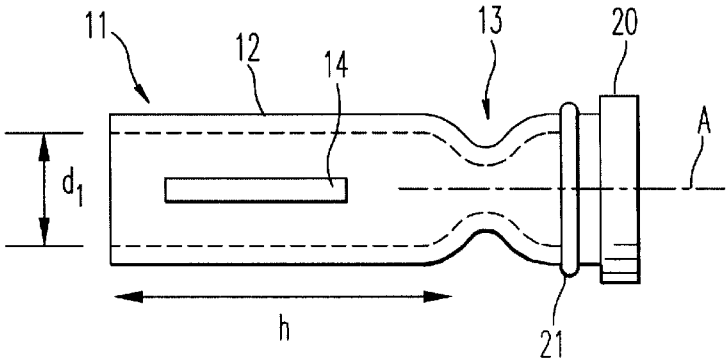
FIGS. 2A–2D are side views of various embodiments of the wiper used in the applicator unit in accordance with the present invention.
Figure 2B:
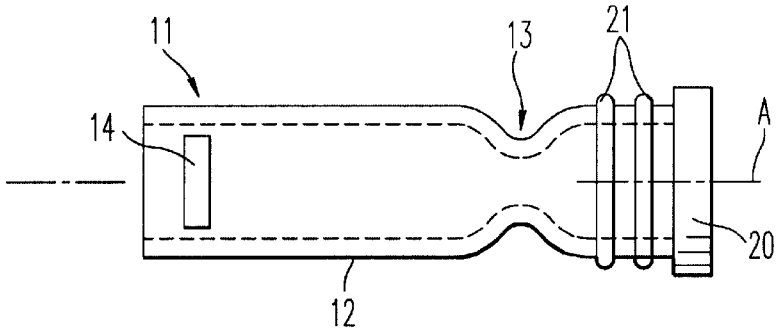
Figure 2C:
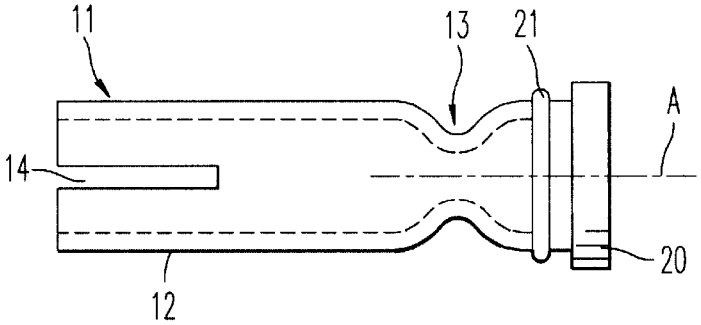
Figure 2D:
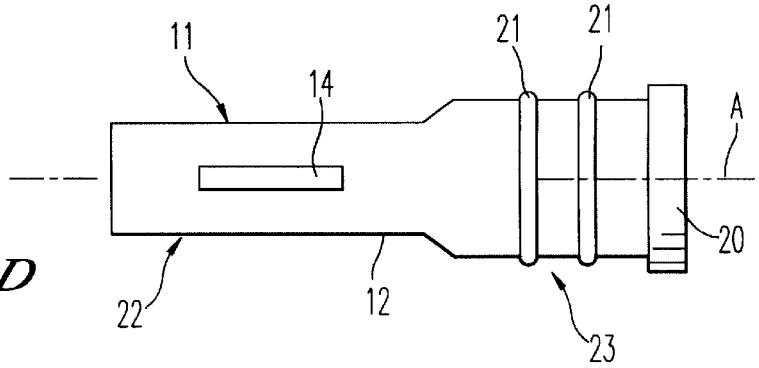

FIGS. 2A–2D illustrate various embodiments of the wiper 11 in accordance with the invention. In the embodiment of FIG. 2A, the sleeve 12 has at least one slot 14 disposed parallel to the axis A of the sleeve 12 to permit, as has been mentioned above, the charging of the wiper 11 on the one hand, and also to increase the capacity of the sleeve 12 to retain some of the product P by the surface tension effect. The wiper 11 has an annular edge 20 intended to come to bear on the free edge of the neck 3 of the reservoir 1. In its upper portion situated above the constriction 13, the external surface of the wiper 11 has one or several beads 21 intended for mounting the wiper 11 in the neck 3 by catch engagement. In the embodiment of FIG. 2B, the feeding slot 14 is orientated substantially perpendicularly to the axis A of the sleeve 12. In the embodiment of FIG. 2C, the slot 14 is orientated parallel to the axis A of the sleeve 12 and opens out on the transverse edge on the opposite side to the annular edge 20. In the embodiment of FIG. 2D, the sleeve 12 does not have a constricted zone. On the other hand, the portion 22 of the sleeve 12 on the opposite side to the annular edge 20 has a smaller diameter than the rest 23 of the sleeve 12.

Figure 3A:
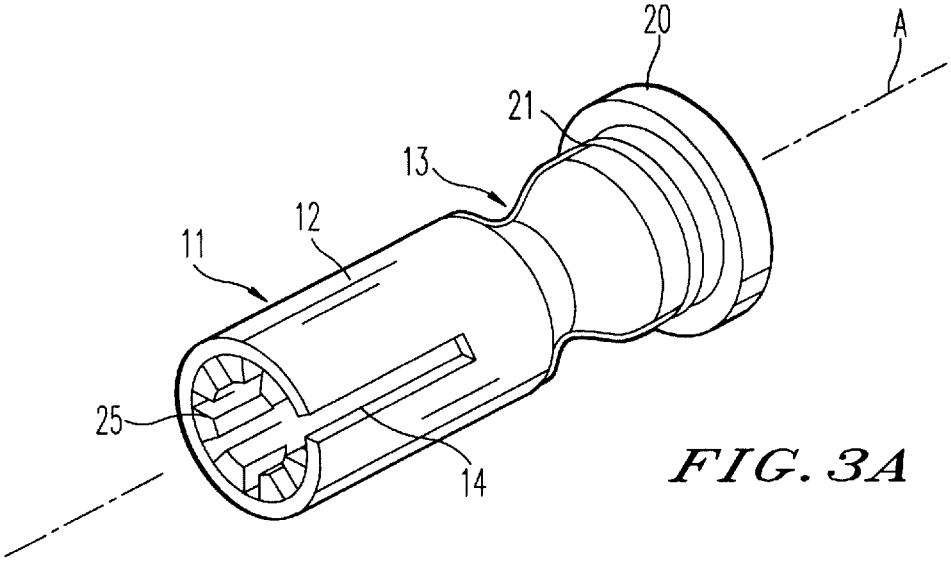
FIGS. 3A–3C are views of yet other embodiments of the wiper used in the applicator unit in accordance with the present invention.

In the embodiment of FIG. 3A, the sleeve 12 has fins or ribs 25 intended to increase the retaining surface of the sleeve 12 over at least a portion of its internal surface, as has been mentioned above, and thus increase its capacity of retaining some of the liquid or semi-liquid product P by the surface tension effect. The diameter of the sleeve 12 at the tip of the fin 25 may be approximately 3 mm for a stem 9 with a diameter of approximately 2.5 mm. The diameter of the sleeve 12 is approximately 5 mm at the bottom of the fins 25. The diameter of the free end of the applicator 8 is of the order of 0.2 mm. The end of the sleeve 12 on the opposite side to the edge 20 may have its internal edge beveled. The fins 25 constitute, moreover, a reduction of the diameter of the sleeve 12 to prevent the ball (26, FIGS. 4–6) from entering into the sleeve, the product P entering into the space or the slots between two adjacent fins and/or through the slots 14.

Figure 3B:
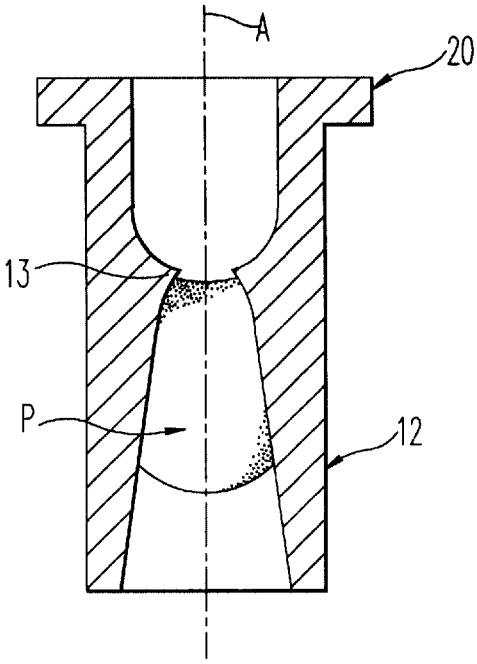

In FIG. 3B, the portion of the sleeve 12 on the opposite side to the annular edge 20 has a frustoconical shape. The diameter decreases in the direction towards the annular edge 20, so as to form the constricted zone 13, the liquid product P being held mainly in the upper portion of the cone in the vicinity of the constricted zone 13.

Figure 3C:
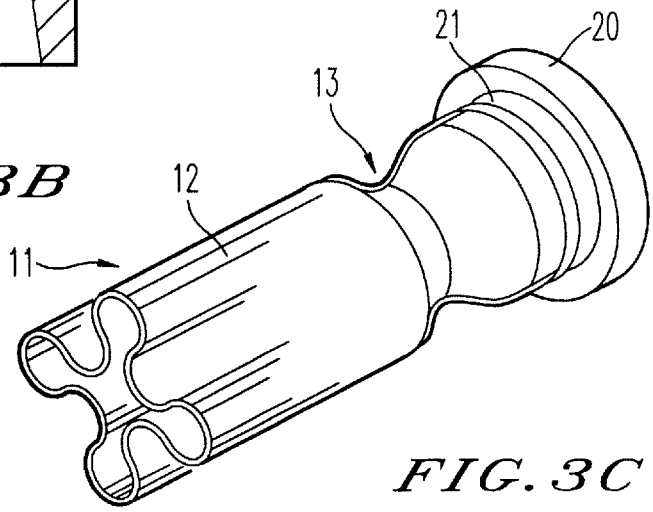

In FIG. 3C, the sleeve 12 has an internal and an external cross-section that is substantially cloverleaf-shaped, so as to increase the retaining capacity of the sleeve 12. According to an alternative, only the internal cross-section is cloverleaf-shaped, the external cross-section being substantially circular. The minimum diameter of the sleeve 12 generated by the concave portions of the cloverleaf is preferably slightly greater than the diameter of the stem 9. The maximum diameter of the sleeve 12 generated by the convex portions of the cloverleaf is distinctly greater than the diameter of the free end of the applicator 8. The sleeve 12 of this embodiment may also have slots or openings 14 for allowing the sleeve 12 to be fed with the product.

FIG. 4 illustrates a packaging unit 100 substantially similar to that illustrated in FIG. 1. In this embodiment, when the stopper 7 is screwed down onto the reservoir 1, the stem 9 passes through the wiper 11 and the applicator 8 is situated practically in the vicinity of the bottom 2 of the reservoir 1 so as to dip into the product P. An element 26, such as a ball, is disposed in the reservoir 1 so as to promote the homogenization of the mixture before use. In this embodiment, the reservoir 1 is mounted practically at the level of the neck 3 of the reservoir 1.

In the same way as in the embodiment discussed with reference to FIG. 1 the applicator 8, shown here in the form of a pencil brush with a smaller diameter than the diameter of the stem 9, passes through the wiping means while not being subjected to practically any physical friction with the sides of the sleeve 12, the wiping of the applicator 8 being effected in essence by the mechanism of the surface tension forces which, as the applicator 8 passes, retain the main portion of the excess liquid on the end of the applicator 8. In fact, when the applicator 8 is raised for the purpose of effecting an application, a first liquid bridge is produced between the applicator 8 and the surface of the liquid P in the reservoir 1. When this liquid bridge is broken, the excess liquid carried by the applicator 8 is retained in the reservoir 1 because of the relatively small volume of liquid on the applicator 8, as compared with the volume of the liquid P in the reservoir 1. In raising the applicator 8 still further, it is caused to pass through the sleeve 12 which, by the surface tension effect, retains the liquid wiped on the surface of the stem 9 by the constriction 13. When the applicator 8 leaves the sleeve 12, a second liquid bridge is produced between the applicator 8 and the surface of the liquid in the sleeve 12. By raising still further, the applicator 8 carried by the stem 9, the liquid bridge is broken. When this liquid bridge breaks, the excess of the product P carried by the end of the applicator 8 is retained in the sleeve 12. A minimum portion of the excess liquid remains on the applicator 8 and rises along the applicator 8 because of the "elasticity" of the liquid, so as to form a substantially uniform film over the surface of the applicator 8.

The packaging unit 100 shown in FIG. 5 differs from that of FIG. 4 in that the wiper is constituted by two parts 120, 121 which are advantageously obtained by the duplex injection molding of two appropriately chosen materials. The part 120 forms the element for wiping the stem 9 by friction. The part 121 forms the element for wiping the applicator 8 by the surface tension effect. The part 120 has an annular skirt 122 surmounted by an annular plate defining, on the one hand, an edge 123 intended to be brought to bear on the free edge of the reservoir 1 and, on the other hand, an element 124 projecting inwardly so as to wipe the stem 9 as the applicator 8 is raised. On the side facing away from the annular skirt 122, the plate carries a second annular skirt 125 with a diameter greater than the diameter of the skirt 122 and whose external surface carries a thread 5 capable of cooperating with the thread 6 provided on the internal side of the stopper 7. In the same way as in the case of the sleeve 121, the element 120 for wiping the stem 9 may be made of a thermoplastic material or of a thermoplastic elastomer.

The element 121 has a skirt 125 whose external diameter is slightly smaller than the internal diameter of the skirt 122. The internal diameter of the skirt 125 is slightly greater than the diameter of the stem 9, so as to permit the charging with the product P by the surface tension effect inside the skirt 125. On the outside of the skit 125, there is provided an element 126 defining a U-shaped annular groove 126 wherein the free edge of the skirt 122 is force-fitted. The external diameter of the annular groove is slightly smaller than the internal diameter of the reservoir 1, so as to permit a tight, leakproof mounting of the wiping unit 120, 121 on the reservoir 1. The skirt 125 has at least one lateral slot 14 to allow the wiper to be charged. In the same way as in the case of the embodiment of FIG. 4, when the stopper 7 is screwed onto the reservoir 1, the stem 9 passes through the wiper 121 and the applicator 8 is situated substantially in the vicinity of the bottom 2 of the reservoir 1 so as to dip into the product P.

In the same way as in the embodiment of FIG. 4, the applicator 8 is mounted on the stem 9 in such a way that a substantially straight element is mounted at the transition between the stem 9 and the applicator 8, this embodiment of applicator 8 having a diameter smaller than the diameter of the stem 9 over the whole length of the applicator 8. This shoulder is either carried by the applicator 8, or by mounting the end of the applicator 8 inside the stem 9. By way of example, the straight shoulder has a radial width of from 0.5 mm to 1.5 mm. In this configuration, there is practically no friction or physical contact between the applicator 8 and the sides of the wiper, including the vicinity of the constriction whose flnction is mainly limited to wiping the stem 9. The substantially straight shoulder improves the wiping effect still further by breaking the surface tension. In fact, the shoulder produces an attachment zone by the surface tension effect, capable of permitting the minimal quantity of the excess liquid which has not been retained in the sleeve, to rise after the liquid bridge between the sleeve and the applicator 8 has been broken.

Figure 6:
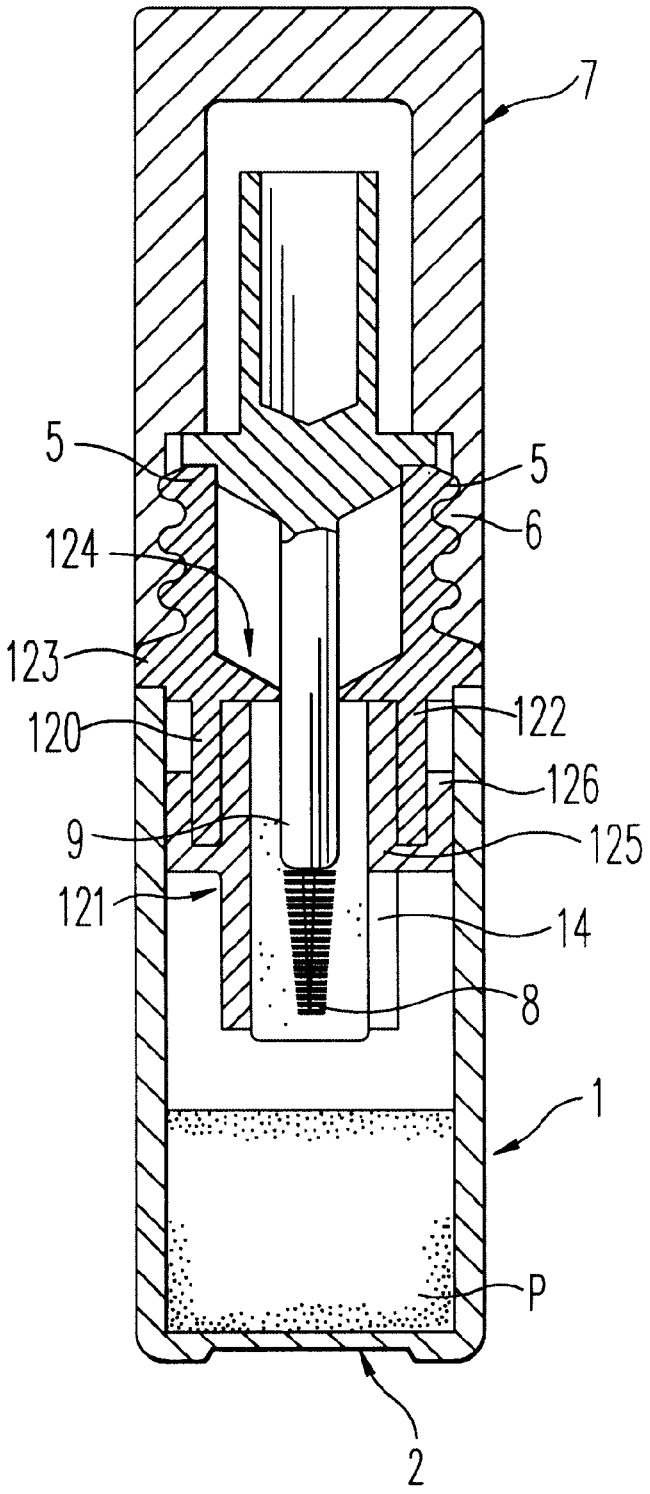
FIG. 6 is a sectional view of a third embodiment of an applicator unit in accordance with the present invention.

The applicator unit shown in FIG. 6 is substantially identical with that of FIG. 5. However, in this embodiment, the applicator 8 is a brush whose bristles may be advantageously covered by a flock coating. Besides, in contrast to the embodiments of FIGS. 4 and 5, when the stopper 7 is screwed down onto the reservoir 1, the applicator 8 stays inside the wiper whose filling is promoted by the feeding slot 14.

Figure 7:
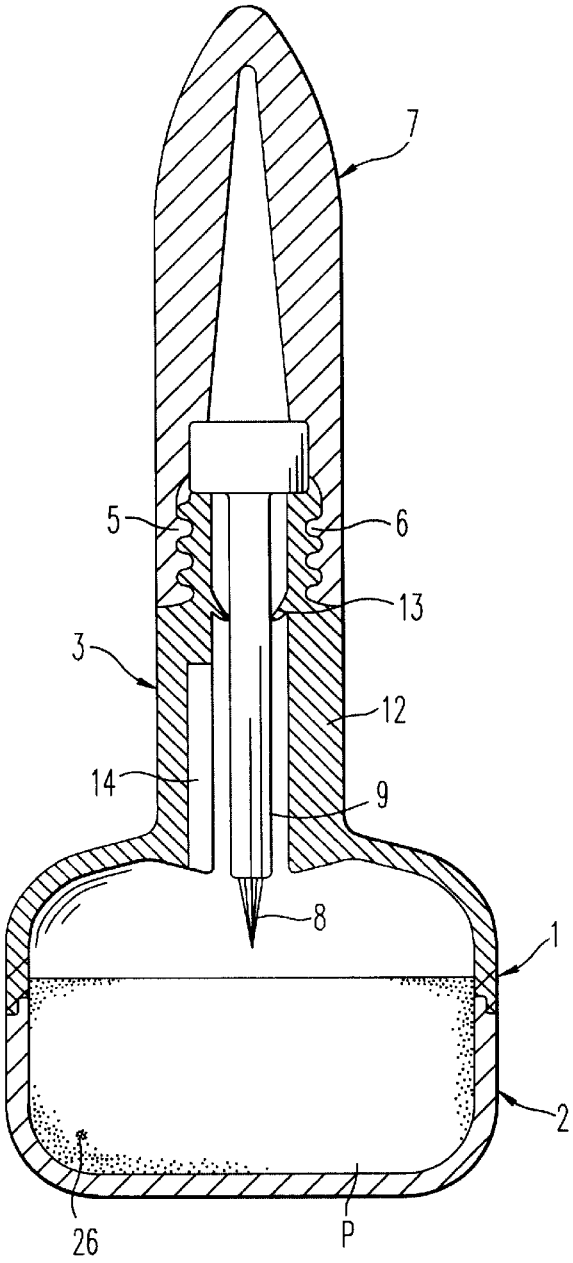
FIG. 7 is another view of an embodiment of the applicator unit in accordance with the invention.

In the embodiment of FIG. 7, the neck 3 of the reservoir 1 forms the sleeve 12 for wiping by means of the surface tension effect, a portion of the reservoir being situated in the neck 3, which makes it possible to have a more compact unit for the same length of the stem 9. It can be obtained by injection molding or by blow molding. The bottom 2 can be bonded or welded in a leakproof manner to the rest of the reservoir 1. In the version shown, the constriction 13 also forms an integral part of the neck 3 and is orientated substantially towards the bottom 2 of the bottle, so as to facilitate and accelerate the breaking of the liquid bridge between the sleeve 12 and the applicator 8. In an alternative, the wiper element of the stem 9 is constituted by an annular part attached to the neck 3.

Figure 8:
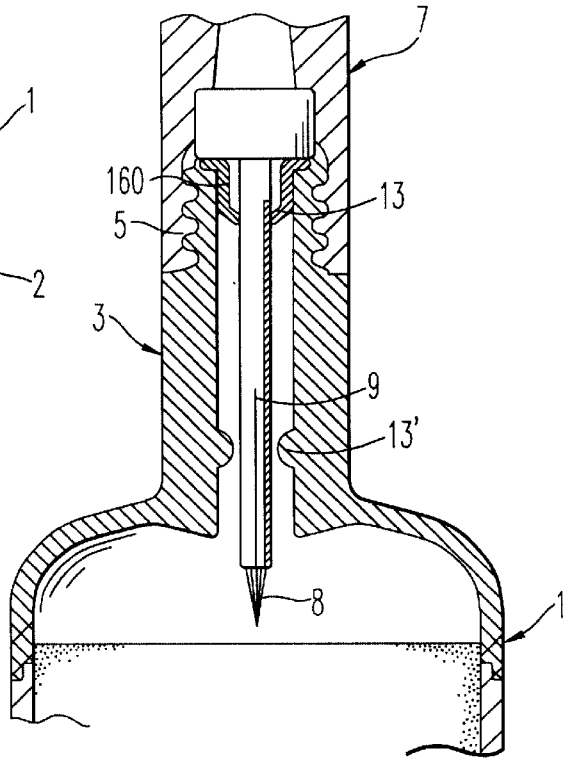
FIG. 8 is another view of an embodiment of the applicator unit in accordance with the invention.

In the device shown in FIG. 8, the sleeve is also formed by the neck 3 of the bottle and is delimited by two constrictions 13, 13', an upper constriction formed by an annular element 160 mounted in a leakproof manner on the neck 3 of the reservoir, and a lower constriction 13' formed directly in the neck 3 of the reservoir, the product P being maintained in position by the surface tension effect between these two constrictions. This configuration contributes to a further improvement of the retention of the liquid in the neck 3 by the surface tension effect.

The applicator unit which has been described above with reference to FIGS. 1 to 8 is particularly advantageous in that it makes it possible to obtain an applicator 8 which is saturated with the product P, but whose end does not have any drop of the excess product, which permits a very precise application and a very fine line. Since the function of the constriction, if applicable, is limited to the wiping of the stem 9, it is no longer necessary to dimension it to the diameter of the applicator 8. This configuration makes it possible, at one and the same time, to obtain a good wiping of the stem 9 (by the friction effect in the constriction and/or by the surface tension effect in the sleeve) and of the applicator 8 (by the surface tension effect in the sleeve) and, because of the small diameter of the end of the applicator 8 as compared with the diameter of the constriction and of the sleeve, makes it possible to prevent the applicator 8 from being damaged when it is introduced into the reservoir. Moreover, the wiping means by the surface tension effect form a product reserve allowing the user to be able to recharge the applicator without having to screw the cap on again. Furthermore, the retention by the surface tension effect situated beneath the wiping diameter makes it possible to prevent the product from passing above the wiper of the stem when the bottle is without its applicator. The wiping remains of the same quality in the course of use, in contrast to some of the conventional devices discussed in the preamble of the present description.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. An applicator unit for a liquid or semi-liquid product, comprising:

a reservoir for containing the product, said reservoir having an opening;

a stopper mountable to the reservoir for obturating said opening;

a stem joined to said stopper;

an applicator carried by said stem and mounted so as to be brought into contact with the product inside the reservoir when said stopper obturates said opening, said applicator having a diameter smaller than or equal to a diameter of the stem; and a wiper situated in the vicinity of said opening configured to wipe substantially an entire length of said applicator by a surface tension, substantially an entire length of said applicator passing through said wiper without substantial friction with said wiper.

2. An applicator unit according to claim 1, wherein said wiper comprises a sleeve through which the applicator charged with the product is caused to pass, said sleeve having a minimum internal diameter greater than the maximum diameter of the applicator, said sleeve being open at its two ends and having an internal surface which retains a reserve of said product by the surface tension effect, and the surface tension force exerted between the internal surface of the sleeve and the product retained therein being greater than the surface tension force exerted between the free end of the applicator and said product.

3. An applicator unit according to claim 2, wherein the sleeve is made of a material selected from the group consisting of material, an elastomer, a thermoplastic, and a heat setting elastomer.

4. An applicator unit according to claim 2, wherein the sleeve has fins disposed parallel to the axis of the sleeve over at least a portion of the internal surface of the sleeve, so as to increase the surface tension force exerted on the product.

5. A packaging unit according to claim 4, wherein the fins have a radial depth of 1 mm to 2 mm.

6. An applicator unit according to claim 2, wherein the sleeve comprises at least one opening passing through a side of the sleeve.

7. An applicator unit according to claim 6, wherein said at least one slot is configured to allow the sleeve to be supplied with the product.

8. An applicator unit according to claim 7, wherein each of said at least one slot is oriented parallel to the axis of the sleeve.

9. An applicator unit according to claim 8, wherein the reservoir has a bottom, and each of said at least one slot opens out on an edge of the sleeve situated opposite the bottom of the reservoir.

10. An applicator unit according to claim 7, wherein each of said at least one slot is orientated perpendicularly to the axis of the sleeve.

11. An applicator unit according to claim 6, wherein the reservoir has a bottom, and the applicator is contained substantially inside the sleeve when the stopper obturates said opening.

12. An applicator unit according to claim 2, wherein the sleeve is formed by a neck of the reservoir.

13. An applicator unit according to claim 12, wherein the sleeve is delimited by upper and lower constrictions, said upper constriction formed by an annular element mounted in a leakproof manner on the neck of the reservoir, and said lower constriction formed in the neck of the reservoir, the product being held by the surface tension effect between the two constrictions, wherein one of the constrictions forms an element for wiping the stem by friction.

14. An applicator unit according to claim 12, further comprising an annular element mounted in a leakproof manner on the neck, said annular element configured to wipe the stem by friction.

15. An applicator unit according to claim 2, wherein the sleeve has a cloverleaf-shaped cross-section.

16. An applicator unit according to claim 1, wherein said wiper comprises a first end situated in the vicinity of said opening, and a second end on the opposite side to the first, said applicator unit further comprising a stem wiper configured to wipe the stem by friction.

17. An applicator unit according to claim 16, wherein the diameter of the applicator varies between a maximum value at its end joined to the stem, and a minimum value at its free end, and the internal diameter of the wiper is equal to 2 to 25 times the minimum value.

18. An applicator unit according to claim 16, wherein said stem wiper comprises a constricted zone arranged in an upper portion of said wiper and configured to wipe the stem during withdrawal of the applicator from the reservoir.

19. An applicator unit according to claim 16, wherein said stem wiper comprises an annular element mounted above said wiper and is configured to wipe said stem during its passage through the annular element.

20. An applicator unit according to claim 19, wherein the annular element is made of a material selected from the group consisting of a thermoplastic material and a thermoplastic elastomer.

21. An applicator unit according to claim 19, wherein said wiper and the annular element are obtained by duplex injection molding of two materials.

22. An applicator unit according to claim 16, wherein, for a product whose viscosity is from $1\times10^{-3}$ Pa.s to 1 Pa.s, the internal diameter of said wiper is from 2 mm to 10 mm, and the height of said wiper up to said stem wiper is from 10 mm to 50 mm.

23. An applicator unit according to claim 22, wherein, for a product whose viscosity is from $1\times10^{-3}$ Pa.s to $5\times10^{-1}$ Pa.s, the internal diameter of said wiper is such that the annular space between the internal surface of said wiper and the stem has a radial width less than or equal to 1 mm, and the height of said wiper up to said stem wiper being from 10 mm to 20 mm.

24. An applicator unit according to claim 1, wherein the reservoir has a bottom, and the internal surface of said wiper has a frustoconical shape whose diameter decreases in the direction opposite to the bottom of the reservoir.

25. An applicator unit according to claim 1, wherein the applicator is held in position in the vicinity of the bottom of the reservoir when the stopper obturates said opening.

26. An applicator unit according to claim 1, wherein the product is selected from the group consisting of a hair product, a liquid serum, a mascara, an eyeliner, eyeshadow, a liquid lip rouge, and a glue.

* * * * *